US005654729A

United States Patent [19]

Garcia

[11] Patent Number: 5,654,729

[45] Date of Patent: Aug. 5, 1997

[54] MICROTIP FLAT PANEL DISPLAY WITH A SWITCHED ANODE

[75] Inventor: Michel Garcia, Les Milles, France

[73] Assignee: Pixel International S.A., Rousset Cedex, France

[21] Appl. No.: 322,990

[22] Filed: Oct. 14, 1994

[30] Foreign Application Priority Data

Oct. 14, 1993 [FR] France ..... 93 12530

[51] Int. Cl.[6] ..... G09G 3/22

[52] U.S. Cl. ..... 345/74

[58] Field of Search ..... 345/58, 72, 74, 345/75, 88, 100, 103; 313/422; 315/169.1, 169.2

[56] References Cited

U.S. PATENT DOCUMENTS 4,868,555 9/1989 Watanabe et al. ..... 345/75

4,940,916 7/1990 Borel et al. .

5,225,820 7/1993 Clerc ..... 345/75

5,402,143 3/1995 Ge et al. ..... 345/75

FOREIGN PATENT DOCUMENTS 0 349 425 1/1990 European Pat. Off. .

*Primary Examiner*—Jeffery Brier

*Attorney, Agent, or Firm*—Plevy & Associates

[57] ABSTRACT

A flat panel display includes cathode columns with microtips for emitting electrons, arranged in gate rows, and an anode provided with phosphor elements arranged in groups of juxtaposed strips, electrically insulated one from the other. The intersection of a gate row and of a cathode column defines a pixel of the display. The groups of anode strips are electrically connected to form two networks. A first network includes groups of strips of odd rank, while the second network includes the groups of strips of even rank. The flat panel display further includes an electronic control system adapted to sequentially address the groups of odd rank, and even rank, respectively.

3 Claims, 2 Drawing Sheets

MICROTIP FLAT PANEL DISPLAY WITH A SWITCHED ANODE

BACKGROUND OF THE INVENTION

1. Field of the Invention

The present invention relates to microtip flat panel displays. It more particularly applies to the realization of a cathodoluminescent anode for such flat panel displays and, in particular, to anode luminescent element connections for operation with a switched anode.

2. Discussion of the Related Art

FIGS. 1 and 2 are a cross-sectional view and a perspective view, respectively, of the structure of a microtip flat panel display according to the present invention.

Such a microtip flat panel display is mainly constituted by a cathode 11 including microtips 10 and by a gate 5 that is provided with holes facing the microtips 10. Cathode 11 faces a cathodoluminescent anode 12 having a glass substrate 2 that constitutes the screen surface.

The operation and the detailed structure of such a microtip flat panel display are described in U.S. Pat. No. 4,940,916 in the name of Commissariat à l'Energie Atomique.

Cathode 11 is constituted, on a glass substrate 7, by cathode conductors 3 disposed in columns. The cathode conductors 3 are generally coated with a resistive layer (not shown) for the homogeneity of the electron emission. An insulating layer 4 to insulate the cathode conductors 3 from gate 5. Holes are respectively provided in the gate layer 5 and the insulating layer 4 to accommodate the microtips 10 that are formed on the resistive layer. Gate 5 is arranged in rows L1, L2, L3. The intersection of a gate row L and of a cathode column 3 defines a pixel. For the sake of simplification, only a few microtips 10 are represented in FIG. 2 at the intersection of a row L with a column 3. In practice, there are several thousands of microtips 10 per pixel.

This device uses the electric field generated between cathode 11 and gate 5 to extract electrons from microtips 10 toward phosphor elements 8 of anode 12 through a vacuum 6.

In the case of a color display, anode 12 is provided with alternate strips of phosphor elements 8, each of which corresponding to a color (blue, red, green). Each strip is electrically insulated from its two adjacent strips. Phosphor elements 8 are deposited onto electrodes 7 that are constituted by corresponding strips of a transparent conductive layer, such as indium-tin oxide (ITO). The strips are disposed in parallel with the cathode columns 3. A group of three strips (one for each color) facing one cathode column. Thus, the width of a group of strips of anode 12 corresponds to a pixel width. The group of blue, red, and green strips are selectively polarized with respect to cathode 11 so that the electrons extracted from the microtips 10 of one pixel are selectively directed toward the phosphor elements 8 facing each of the colors.

Conventionally, all the strips of the same color are electrically interconnected, outside the useful surface of the display, to an electronic control system (not shown). On the cathode side, each cathode column 3 and each gate row L is individually connected to the electronic control system.

An image is displayed during a frame period (for example 20 ms) by adequately polarizing anode 12, cathode 11 and gate 5 through an electronic control system. During a frame period, the group of strips of phosphor elements 8 of a same color is sequentially polarized, that is, each group is polarized for a sub-frame period corresponding to one third of the frame period (for example 6.6 ms). Display is performed line after line, by sequentially polarizing the gate rows for a "line time" during which each cathode column is raised to a potential that depends upon the brightness of the pixel to be displayed along the current row in the selected color. The polarization of columns 3 of cathode changes at each new row of the line scan. A "line time" (for example 13.7 μs) corresponds to the duration of one sub-frame divided by the number of gate rows.

Therefore, the groups of strips of phosphor elements 8 are sequentially raised to a potential that permits to attract the electrons emitted by the microtips 10. This potential depends upon the distance (vacuum 6) which separates the cathode/gate from the anode and is, for example, higher than 250 V. The gate rows are sequentially polarized during a sub-frame period. A specific row L is raised to a potential (for example 80 V) whereas the remaining rows are at a zero potential during the "line time" of the current row. The cathode columns, whose potential represents at each line the brightness of the pixel defined by the intersection of column 3 with row L in the selected color, are raised to respective potentials between a maximum emission potential and the absence of emission of potential (for example, 0 and 30 V, respectively). The values of the polarization potentials are selected as a function of the phosphor elements 8 and microtips 10. Conventionally, below a potential difference of 50 V between the cathode and the gate, there is no electron emission and the maximum emission corresponds to a potential difference of 80 V.

A drawback of conventional flat panel displays lies in that electrons emitted by microtips 10 of a specific column 3 of cathode 11 tend to excite the strips of phosphor elements 8 of the same colors facing two adjacent columns 3. Indeed, although two strips of a same color are separated by two strips of a different color, the distance (approximately 0.2 mm) between the phosphor elements 8 and microtips 10 leads the electrons to deviate towards the nearest strips of the same color. This illumination of adjacent pixels is increased when groups of strips of phosphor elements 8 are misaligned with respect to the cathode columns, which may occur during assembling of the display.

In the case of a monochrome display, the simplest way to realize an anode 12 includes depositing, over the whole substrate 2 of anode 12, a conductor 7 coated with continuous phosphor elements 8. Anode 12 is permanently polarized. The selection of the excited areas of the display by the electrons emitted by microtips 10 is controlled by the respective polarizations of cathode columns of gate rows. The drawbacks of the color displays are still more accentuated in such monochrome displays.

SUMMARY OF THE INVENTION

An object of the present invention is to obviate these drawbacks by providing a flat panel display with a good definition and a satisfactory proximity contrast.

To attain this object, the invention provides a flat panel display including a microtip cathode for emitting electrons, arranged in columns, a gate arranged in rows and an anode provided with phosphor elements arranged in groups of juxtaposed strips, electrically insulated one from the other. The intersection of a row of the gate and of a column of the cathode defines a pixel of the display. The groups of strips of the anode are electrically connected to form two networks. The first network includes groups of strips of odd rank, while the second network includes the groups of strips of even rank. The display is associated with an electronic control system adapted to sequentially address the groups of odd rank, and even rank, respectively.

According to an embodiment of the invention, the groups of phosphor strips are parallel with the cathode columns and have a width substantially identical to the width of these columns.

According to an embodiment of the invention, the cathode columns are individually addressed by the electronic control system in two networks corresponding to the connection networks of the groups of anode strips.

According to an embodiment of the invention, the electronic control system includes an inverter for inverting the addressing of the network of the connection groups of the phosphor strips.

According to an embodiment of the invention, the groups of phosphor strips are parallel with the rows of the gate and have a width substantially identical to the width of these rows.

According to an embodiment of the invention, the electronic control system includes means for sequentially addressing the gate rows of even rank, respectively odd rank, simultaneously as it addresses the groups of phosphor strips of even rank, respectively odd rank.

According to an embodiment of the invention, each of the groups is constituted by a phosphor strip, the phosphor elements of all the groups being of the same type.

According to an embodiment of the invention, each of the groups is constituted by three phosphor strips of different colors, each network including three sets of phosphor strips. The strips are electrically interconnected, and the electronic control system includes means for individually addressing each set of the same network.

The foregoing and other objects, features, aspects and advantages of the invention will become apparent from the following detailed description of the present invention when taken in conjunction with the accompanying drawings.

BRIEF DESCRIPTION OF DRAWINGS

For the sake of clarity, the figures are not drawn to scale and the same elements are designated in the various figures with the same references.

DETAILED DESCRIPTION

Figure 1:
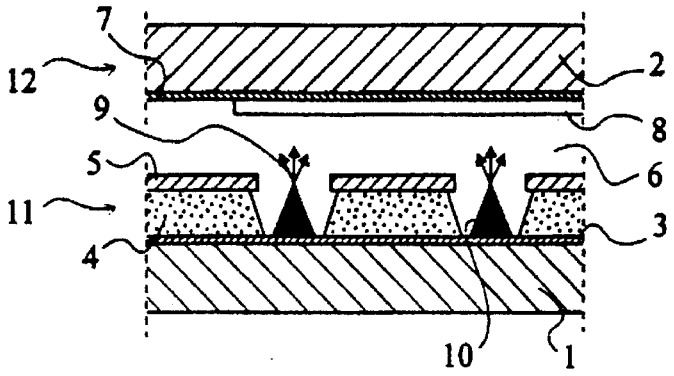
FIGS. 1 and 2, above described, illustrate the state of the art and the problem encountered.
Figure 2:
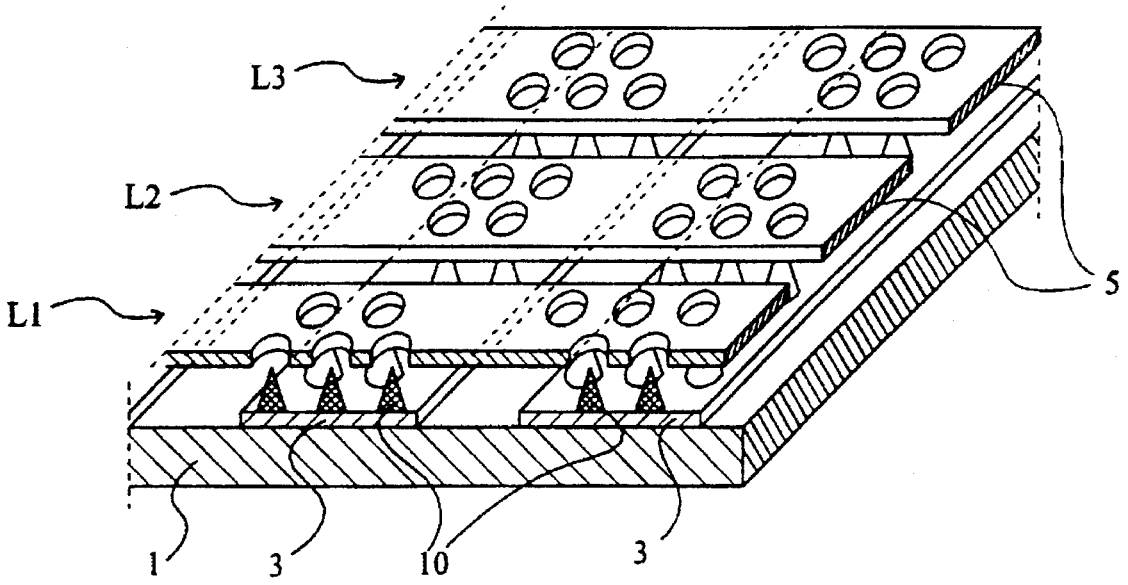
Figure 3:
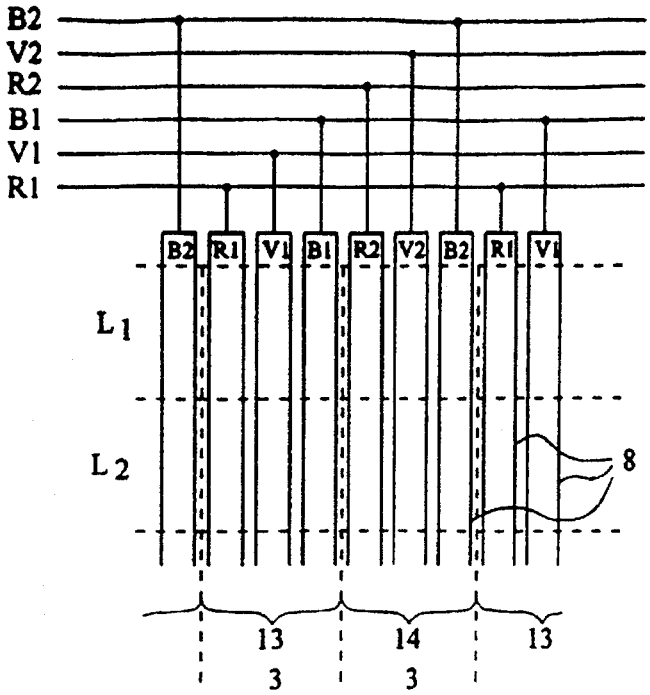
FIG. 3 is a schematic front view of an anode used in a flat panel display according to a first embodiment of the invention for application to color displays.

As shown in FIG. 3, a basic feature of the present invention lies in the electric interconnection of strips of the phosphor elements of the anode. In this case, the strips are no longer interconnected by color but in two networks (R1, V1, B1; R2, V2, B2) of strips by color. A specific strip (for example B1) is not only electrically insulated from all the remaining strips of the two other colors (for example R1, V1, R2, V2) but also from the two nearest strips of the same color (for example B2). In other words, the strips of two adjacent groups 13, 14 are each connected to a different network.

In FIG. 3, cathode columns 3 and gate rows L are symbolically represented in dotted lines, the width of a group 13, 14 corresponding to the width of a column 3.

This interconnection structure of phosphor strips 8 of the anode 12 is controlled according to a sequential addressing of the two strip networks at each image frame, in addition to the sequential addressing of the strips of the same color belonging to a same network.

An image is always displayed during a frame period (for example 20 ms) by means of an electronic control system (not shown). During a frame period, the strips of phosphor elements 8 of anode 12 are sequentially polarized by groups of strips of a same color, but one network at a time. A frame is then partitioned into six sub-frames of a duration (for example 3.3 ms) corresponding to 1:6 of the frame period.

Display is always carried out one line at a time by sequentially polarizing the gate rows L. However, in the present case, each row L is polarized six times for a given frame, the sequential polarization of all rows L is resumed for each sub-frame.

Also, the addressing of columns 3 of cathode 11 is modified to duplicate, on the cathode side, a sequential addressing of two networks of columns 3 similar to the networks formed on the anode side. Thus, during each "line time" which corresponds to the polarization of a specific gate row L during line scanning, every two columns is raised to a potential that depends upon the brightness of the pixel to be displayed along the current line in the considered color.

However, care must be taken so that the network of cathode columns (polarized during a sub-frame period) actually corresponds to the network of the groups of phosphor elements facing it. To perform this synchronization, it is possible, for example, to use an inverter or a simple jumper link to invert the order of the networks of anode 12 during their sequential operation controlled by the electronic control means. Such an inverter or jumper link will be, for example, definitively positioned during a test of the flat panel display after its assembling.

The present invention makes it possible for the electrons emitted by the cathode microtips 10 to be attracted onto a polarized phosphor strip 8 of anode 12 (for example R2), without possibility for the electrons to be captured by strips of a same color (for example R1) of the two adjacent groups 13.

However, this involves that the excitation period of a phosphor element 8 of a pixel must be halved in order to maintain the frame period of an image.

To maintain the brightness of a flat panel display, a double electric intensity is therefore necessary. Indeed, the illumination of a phosphor element 8 is proportional to its excitation period and to the intensity of the electron bombardment.

Although the first embodiment according to the present invention increases the current consumption of the flat panel display and the number of switchings that must be performed by the electronic control system, it highly improves the proximity contrast of the flat panel display.

Also, due to a better electron concentration, the present invention allows an increase of the gap 6 between anode and cathode. In practice, a short gap 6, that is necessary for collecting electrons on one anode strip in conventional flat panel displays, limits the anode-cathode potential in order to avoid formation of electric arcs that would destroy the flat panel display. With the present invention, the anode-cathode distance can be increased without impairing the collection of electrons, and a higher potential can be applied to anode 12 to increase the brightness of the display.

The present invention further allows the reduction of the size of the pixels to improve the resolution.

Figure 4:
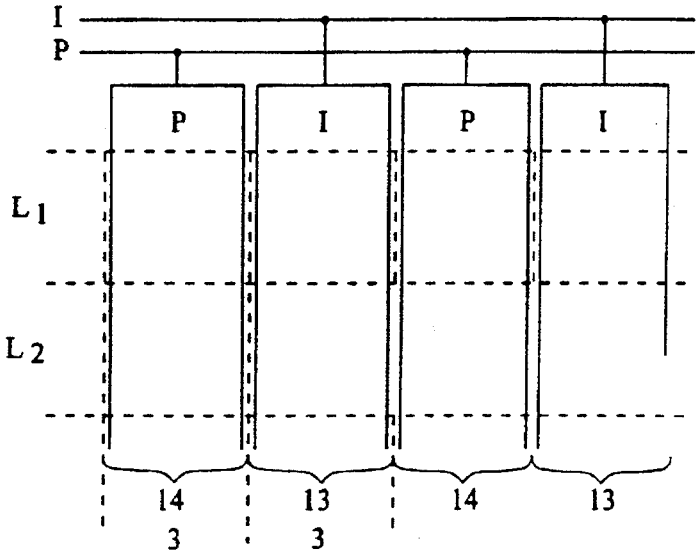
FIG. 4 schematically represents an anode used in a flat panel display according to the first embodiment of the invention for application to a monochrome display.

FIG. 4 illustrates the application of the first embodiment according to the present invention to a monochrome display.

The technology of color displays (namely, deposition of phosphors 8 onto parallel conductive strips, electrically insulated one from the other) is used but all the phosphor elements are in the present case of the same type since the display is monochrome. The strips are interconnected in order to form two networks I, P, two adjacent strips being each connected to one of the two networks. In monochrome displays, the width of a strip corresponds to the width of a pixel defined, as above, by the intersection of a cathode column and a gate row. Columns 3 and rows L as symbolically represented in dotted lines in FIG. 4.

Thus, the contrast and definition of the monochrome displays are significantly improved.

Figure 5:
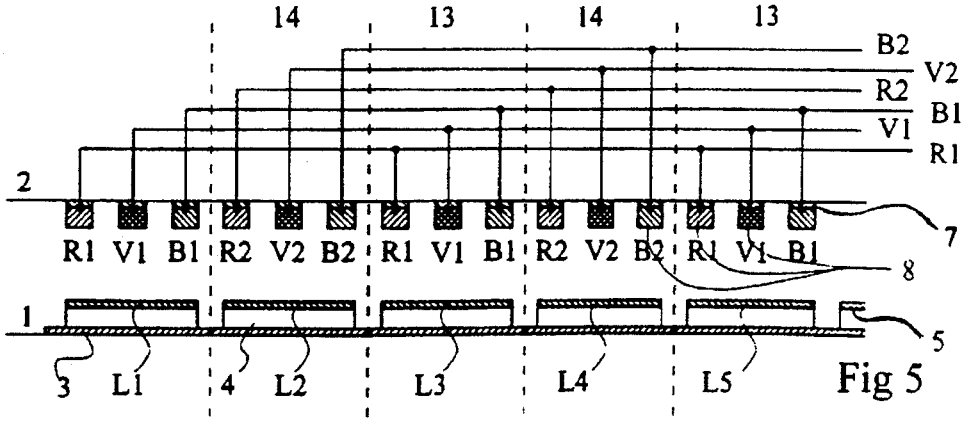
FIG. 5 is a schematic cross-sectional view of a flat panel display according to a second embodiment of the invention for application to a color display.

FIG. 5 represents a second embodiment of the present invention that reduces the number of column switchings down to the same number as in conventional displays and thus limits the current consumption of the electronic control system.

In this second embodiment, the phosphor strips 8 deposited on the conductors 7 of anode 12 are now parallel with the gate rows. A pixel is still defined by the intersection of a gate row and a cathode column. The width of a group of strips (R, V, B) of anode 12 corresponds to the gate row width.

The interconnection of the phosphor strips is the same as the one described with relation to FIG. 3.

In the present case, the respective polarizations of cathode 11, anode 12 and gate 5 are performed by the electronic control system as follows.

An image is still displayed during a frame period (for example 20 ms). During a frame period, the phosphor strips 8 of anode 12 are sequentially polarized for each color and, within each group of color strips, they are sequentially polarized for each network. In other words, the strips of even (or odd) rank of a first color are polarized; then, the strips of odd (or even) rank of this first color are polarized; last, the strips of odd (or even) rank of the second color are polarized, and so on.

Display is still carried out one line at a time by sequentially polarizing the gate rows but, in this case, every two lines. In other words, during a first sequence of a sub-frame that corresponds to the polarization of the strips of the first network of a color (i.e., half a sub-frame), the rows of odd (or even) ranks are sequentially polarized. Then, during a second sequence corresponding to the polarization of the strips of the second network of the same color (i.e., the other half of the sub-frame), the rows of even (or odd) ranks are polarized.

In contrast, the polarization of cathode 11 is again the same as that of the conventional flat panel displays. That is, during each "line time" that corresponds to the polarization of a gate row during line scanning, all cathode columns are raised to a potential that depends upon the brightness of the pixel to be displayed along the current line in the considered color. Thus, in this second embodiment, the number of line scanning operations is halved with respect to the first embodiment. Accordingly, with respect to the first embodiment, the number of switching operations of cathode 11 is halved and the power consumption of the electronic control system is substantially reduced. Indeed, whereas in the first embodiment the gate rows are sequentially polarized six times for each frame (once for each of the six sub-frames), they are now polarized three times only for each frame.

When implementing this second embodiment, care should be taken so that the size of conductors 7 on which are disposed the phosphor elements 8 is sufficient to withstand the current needed for the simultaneous attraction of electrons along the whole strip of phosphor elements 8. Indeed, whereas in the first embodiment the global line current is distributed over all the strips that are parallel with the cathode columns, this current must now be capable of flowing through a single conductor 7 because the strips are parallel with the gate rows.

To achieve this purpose, it is possible, for example, to enhance conductors 7 (that are conventionally realized by ITO deposition) with deposition of a conductive material on both sides of the phosphor elements 8.

It is also possible to make use of the fact that the anode voltage can now be higher to increase the anode-cathode gap 6 and to deposit a thin film of aluminum onto the phosphor elements 8. The increased energy of electrons allows them to pass through this thin aluminum film.

As is apparent to those skilled in the art, various modifications can be made to the above disclosed preferred embodiments. More particularly, the practical construction of the electronic control system to comply with the operation constraints described with relation to the interconnection of the phosphor strips can readily be achieved by those skilled in the art.

I claim:

1. A flat panel display including:

a cathode with microtips for emitting electrons arranged in columns, a gate arranged in rows including odd rows and even rows which are sequential addressed, an anode provided with phosphor elements arranged in groups of juxtaposed strips electrically insulated one from the other, the intersection of a gate row and of a cathode column defining a pixel of the display, wherein the groups of phosphor elements include odd rank groups and even rank groups which are sequentially addressed, the odd rank groups are connected together forming a first network, while the even rank groups are connected together forming a second network separate from the first network, an electronic control system adapted to sequentially address the groups of odd rank elements and even rank elements, respectively, and wherein the groups of phosphor strips are parallel with the cathode columns and have a width substantially identical to the width of the columns.

2. The flat panel display of claim 1, wherein the cathode columns are individually addressed by the electronic control system in two networks corresponding to the connection networks of the groups of said strips.

3. The flat panel display of claim 2, wherein the electronic control system includes an inverter for inverting the addressing of the network of the connection groups of phosphor strips.

* * * * *